US009427880B2

(12) United States Patent
Carlucci et al.

(10) Patent No.: US 9,427,880 B2
(45) Date of Patent: Aug. 30, 2016

(54) PERSONAL GROOMING APPARATUS AND BLADE ASSEMBLY

(75) Inventors: Vito Carlucci, Stratford, CT (US); Sergio Lopes Fernandes da Costa, Danbury, CT (US)

(73) Assignee: CONAIR CORPORATION, Stamford, CT (US)

( * ) Notice: Subject to any disclaimer, the term of this patent is extended or adjusted under 35 U.S.C. 154(b) by 618 days.

(21) Appl. No.: 13/573,101

(22) Filed: Aug. 21, 2012

(65) Prior Publication Data

US 2014/0053412 A1 Feb. 27, 2014

(51) Int. Cl.
*B26B 19/02* (2006.01)
*B26B 19/38* (2006.01)

(52) U.S. Cl.
CPC ..... *B26B 19/3846* (2013.01)

(58) Field of Classification Search
CPC ..... B26B 19/3846
See application file for complete search history.

(56) References Cited

U.S. PATENT DOCUMENTS 4,393,585 A 7/1983 Nagelkerke
5,054,199 A 10/1991 Ogawa et al.
6,317,982 B1 11/2001 Andrew
6,601,302 B2 8/2003 Andrew
6,604,287 B2 8/2003 Melton et al.
6,957,490 B2 10/2005 Wilcox
7,762,001 B2 7/2010 Morisugi et al.
2003/0051346 A1* 3/2003 McCambridge et al. ..... 30/122
2003/0051347 A1 3/2003 Melton et al.
2010/0139097 A1 6/2010 Perez-Lopez et al.
2011/0167639 A1* 7/2011 Lau ..... 30/34.1

FOREIGN PATENT DOCUMENTS

WO WO 2009/062045 A1 5/2009

* cited by examiner

*Primary Examiner* — Stephen Choi
(74) *Attorney, Agent, or Firm* — Carter, DeLuca, Farrell & Schmidt, LLP

(57) ABSTRACT

A personal grooming apparatus includes a handle defining a central longitudinal axis, first and second blade sets mountable relative to the handle with each blade set including a stationary blade member and a movable blade member, and a drive mechanism disposed within the handle and operatively coupled to the movable blade members of the first and second blade sets. The drive mechanism is operable to cause corresponding reciprocating movement of the movable blade members relative to the stationary blade members of each of the first and second blade sets. The second blade set may be releasably mountable to said first blade set. The first and second blade set each may include a housing for at least partially accommodating respective stationary and movable blade members.

18 Claims, 10 Drawing Sheets

PERSONAL GROOMING APPARATUS AND BLADE ASSEMBLY

BACKGROUND

1. Field of the Invention

The present invention relates to a personal grooming apparatus. More particularly, the present invention relates to a hair clipper and blade assembly. The blade assembly includes a first blade set and a releasably mounted second blade set. The second blade set may be detached depending on the intended use of the apparatus.

2. Description of the Related Art

Hair clipper apparatii are known in the art with examples of such devices being disclosed in commonly assigned U.S. Pat. Nos. 6,536,116 and 6,742,262, U.S. Design Pat. Nos. D464,466, D458,411, D456,950, and D653,812 and U.S. Patent Publication No.: 20020162226, the entire contents of each of these disclosures being hereby incorporated by reference herein. These devices or tools have proven to be quite effective for their intended uses.

SUMMARY

Accordingly, the present disclosure relates to a personal grooming apparatus including a handle defining a central longitudinal axis, first and second blade sets mountable relative to the handle with each blade set including a stationary blade member and a movable blade member, and a drive mechanism disposed within the handle and operatively coupled to the movable blade members of the first and second blade sets. The drive mechanism is operable to cause corresponding reciprocating movement of the movable blade members relative to the stationary blade members of each of the first and second blade sets. The second blade set may be releasably mountable to the first blade set to improve cutting functions and/or improve versatility of the apparatus. The first and second blade set each may include a housing for at least partially accommodating respective stationary and movable blade members.

The drive mechanism may include a rotating eccentric cam shaft operatively coupled to the movable blade members of the first and second blade sets such that rotational movement of the eccentric cam shaft causes corresponding reciprocating movement of the movable blade members. The movable blade member of the first blade set may be coupled to the eccentric cam shaft and the movable blade member of the second blade set may be coupled to the movable blade member of the first blade set.

The second blade set may include a drive element which is operatively coupled to the movable blade member thereof and to the movable blade member of the first blade set whereby reciprocating movement of the movable blade member of the first blade set causes corresponding reciprocating movement of the drive element to effect reciprocating movement of the movable blade member of the second blade set. The drive element may include a drive post depending outwardly relative to the movable blade member of the second drive set. The drive post may extend within the housing of the first blade set and is operatively couplable to the movable blade member of the first blade set. The first blade set may include a reciprocating member coupled to the movable blade member and to the cam shaft of the drive mechanism.

In accordance with another aspect of the present disclosure, the first and second blade sets are movable relative to each other between an operative condition and a release position where said first and second blade sets may be released. The first and second blade sets may be normally biased toward the operative condition thereof. One of the first and second blade sets includes a main locking latch. The main locking latch is adapted for movement between a lock position corresponding to the operative condition of the first and second blades sets and an unlock position corresponding to the release position of the first and second blades sets. The main locking latch may be normally biased toward the lock position. The other of the first and second blade sets may define a latch shelf where the locking latch is engagable with the latch shelf during movement between the lock and unlock positions thereof. At least one supplemental latch depends outwardly from the housing of the one of the first and second blade sets. The at least one supplemental latch is received within a correspondingly dimensioned supplemental latch opening in the housing of the other of the first and second blade sets whereby movement of the first and second blade sets to the release position permits removal of the at least one supplemental latch from the correspondingly dimensioned supplemental latch opening to permit removal of the second blade set from the first blade set. At least two of said supplemental latches may depend outwardly from the housing of the one of the first and second blade sets and received within correspondingly dimensioned supplemental latch openings in the housing of the other of the first and second blade sets. The first blade set may be releasably mountable to the handle.

In accordance with another aspect of the present disclosure, a blade assembly for use with a hair clipper includes a first blade set for mounting to the hair clipper and a second blade set for mounting to the first blade set. The first blade set includes a first housing, a first movable blade member and a first stationary blade member. The first moveable member is adapted for reciprocal movement relative to the stationary blade member. The second blade set includes a second housing, a second movable blade member and a second stationary blade member. The second housing is movable between an operative condition mounted to the first housing of the first blade set with the second movable blade member operatively coupled to the first movable blade member, and a release condition permitting release from the first housing. The second blade set includes a drive element operatively coupled to the second movable blade member and to the first movable member when in the operative condition thereof whereby movement of the first movable blade member causes corresponding reciprocating movement of the second movable blade member.

The housing of the second blade set may include a main locking latch. The main locking latch is adapted for movement between a lock position corresponding to the operative condition of the first and second blades sets and an unlock position corresponding to the release position of the first and second blades sets. The main locking latch may be normally biased toward the lock position. At least one supplemental latch may depend outwardly from the housing of the second blade set. The at least one supplemental latch is received within a correspondingly dimensioned supplemental latch opening in the housing of the first blade set whereby movement of the first and second blade sets to the release position permits removal of the at least one supplemental latch from the correspondingly dimensioned supplemental latch opening to permit removal of the second blade set from the first blade set.

BRIEF DESCRIPTION OF THE DRAWINGS

Various embodiments of the present disclosure are described hereinbelow with references to the drawings, wherein.

DETAILED DESCRIPTION OF THE EMBODIMENTS

Figure 1:
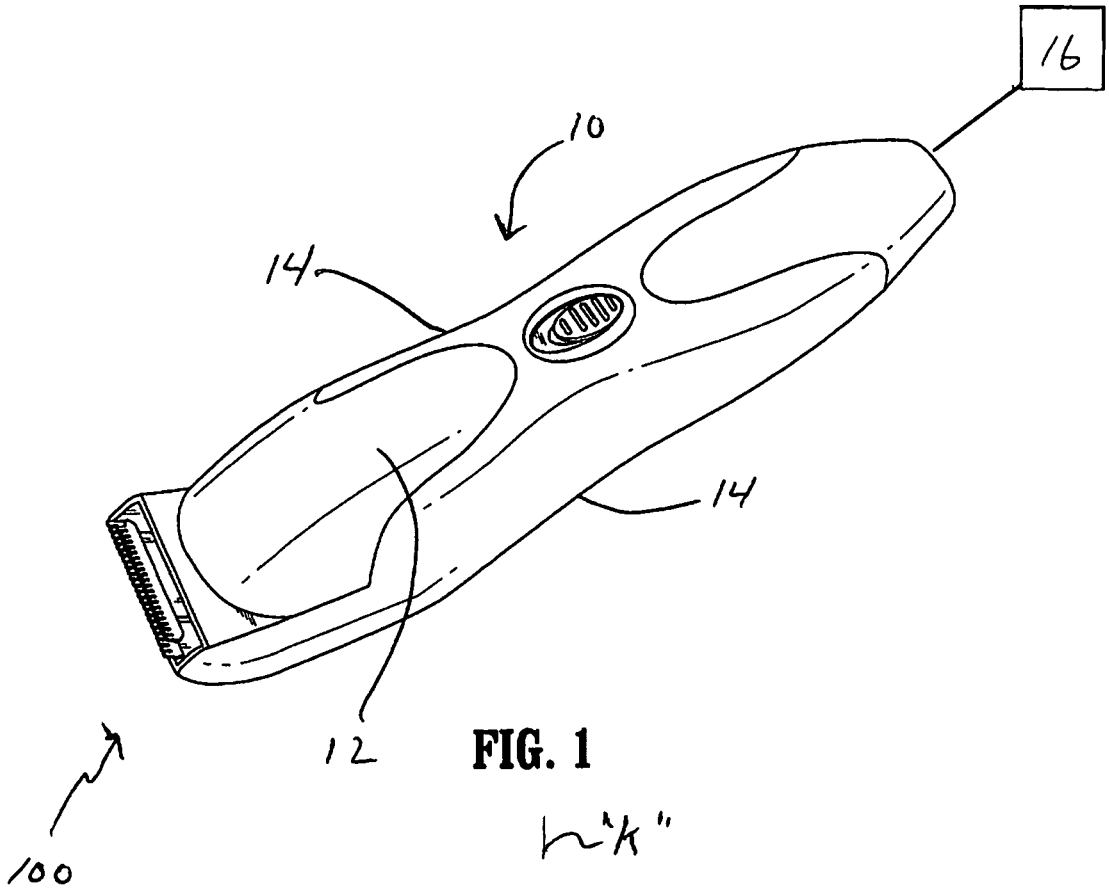
FIG. 1 is a perspective view of a personal grooming apparatus and blade assembly in accordance with the principles of the present disclosure.

Referring to the drawings and, in particular, to FIG. 1, there is shown a personal grooming apparatus in accordance with the principles of the present disclosure. Hair grooming apparatus 10 is a hair trimmer or clipper and incorporates a blade assembly 100 which provides versatility of use to the subject and improved cutting function.

Figure 2:
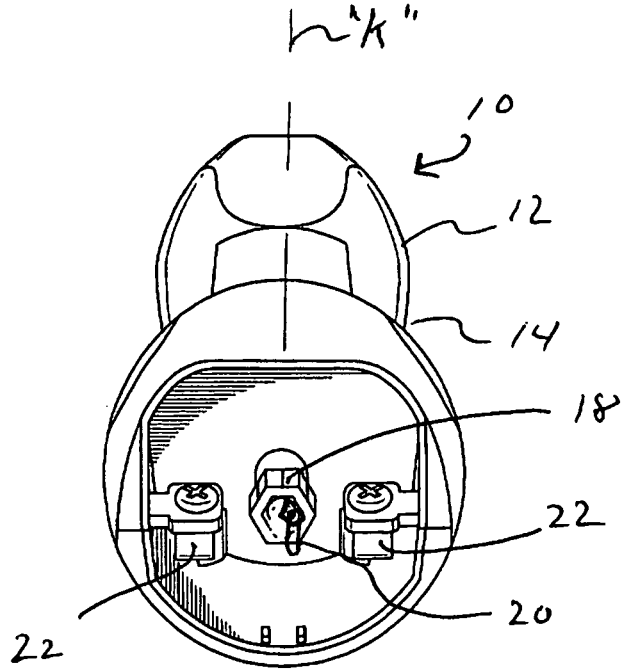
FIG. 2 is an axial view illustrating the forward end of the handle of the personal grooming apparatus with the blade assembly removed.

Grooming apparatus 10 includes handle 12 dimensioned for engagement by the subject. Handle 12 may be elongated and incorporate surface contours 14 to facilitate manipulation by the subject. Disposed within the handle 12 is a motor, shown schematically as 16, and associated circuitry, to control operation of the motor. As best depicted in FIG. 2, the forward or leading end of handle 12 includes a central drive shaft 18, which is connected to the motor 16, and an eccentric drive or cam post 20 mounted to the drive shaft 18. The central drive shaft 18 rotates about a shaft axis "k" in response to actuation of the motor 16. The cam post 20 is arranged off-axis relative to the shaft axis "k" to actuate the blade assembly 100 in an eccentric camming manner as will be discussed. The handle 12 further includes a pair of opposed mounting legs 22 secured to the internal surface of the handle 12 through conventional means, e.g., screws, fasteners or the like. The mounting legs 22 secure the blade assembly 100 to the handle 12. The drive shaft 18 and the mounting legs 22 each may be formed of a resilient polymeric material while the eccentric cam post 20 may be made of a metal such as stainless steel. Other materials are also envisioned. The motor 16 may be any suitable rotary motor adapted to impart rotational movement to the central drive shaft 18. The circuitry associated with the motor may include on/off switch, variable speed functions, etc.

Figure 3A:
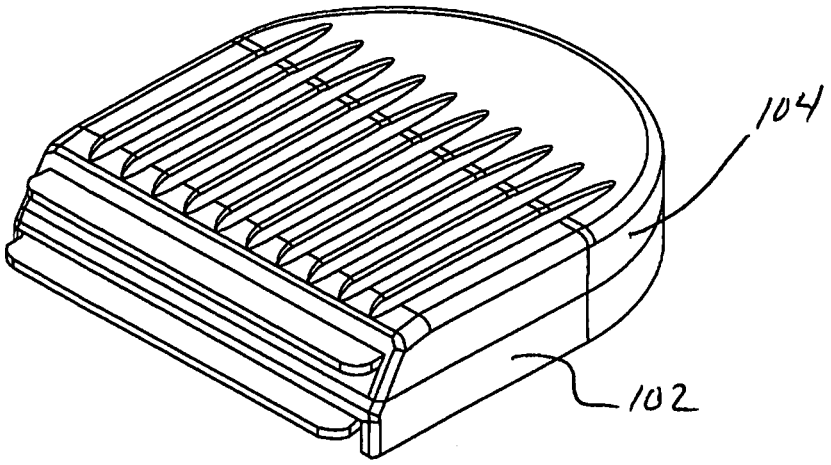
FIGS. 3A and 3B are first and second perspective views of the blade assembly of FIG. 1 illustrating the first and second blade sets in an assembled condition.
Figure 3B:
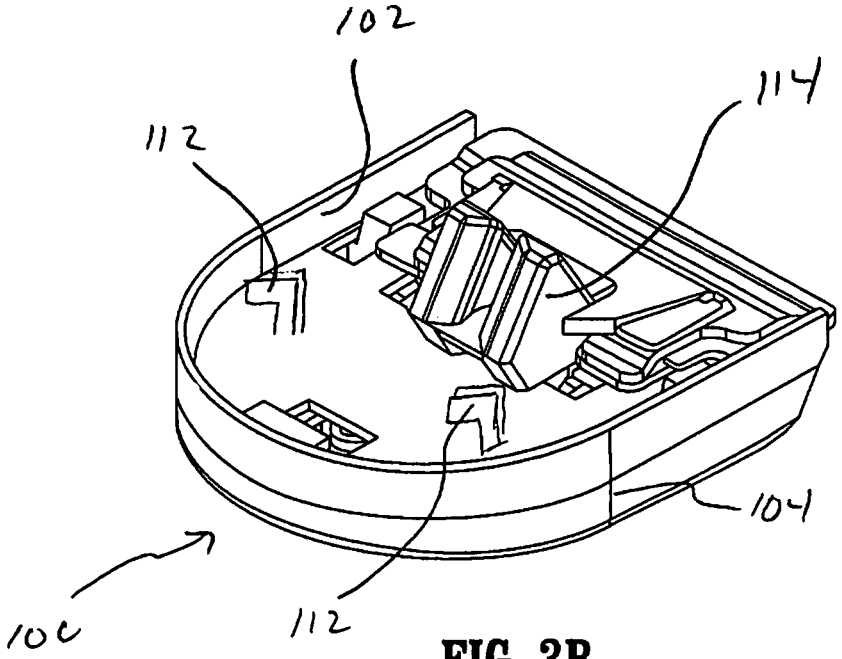

FIGS. 3A and 3B illustrate the blade assembly 100 in an assembled condition. FIG. 3A illustrates the external or subject side of the blade assembly 100 and FIG. 3B illustrates the trailing or handle side of the blade assembly 100. In general, the blade assembly 100 includes first and second blade sets 102, 104 which may be assembled together and mounted to the handle 12 of the grooming apparatus 10. The second blade set 104 is releasably mounted to the first blade set 102 to provide variable cutting functions and versatility to the grooming apparatus 10.

Figure 4A:
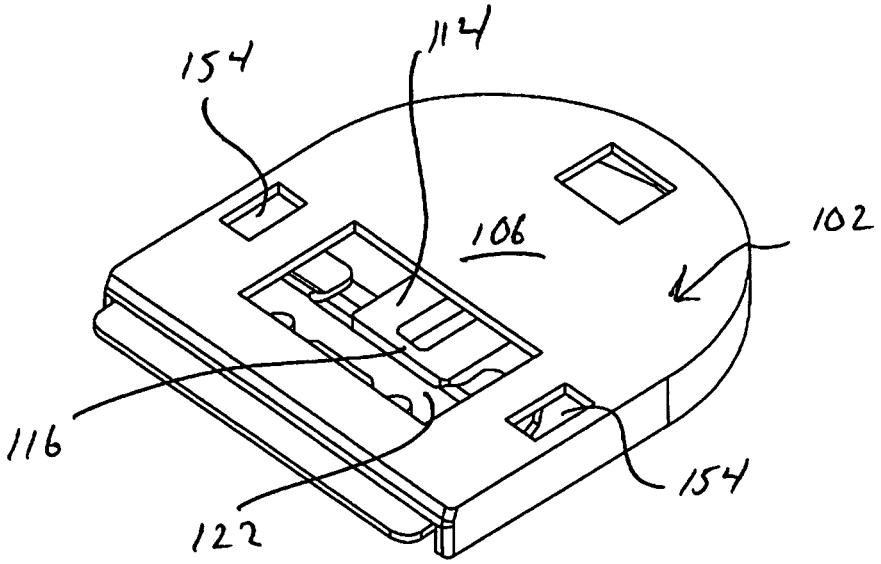
FIGS. 4A and 4B are perspective views of the first blade set of the blade assembly illustrating the treatment and trailing sides of the first blade set.
Figure 4B:
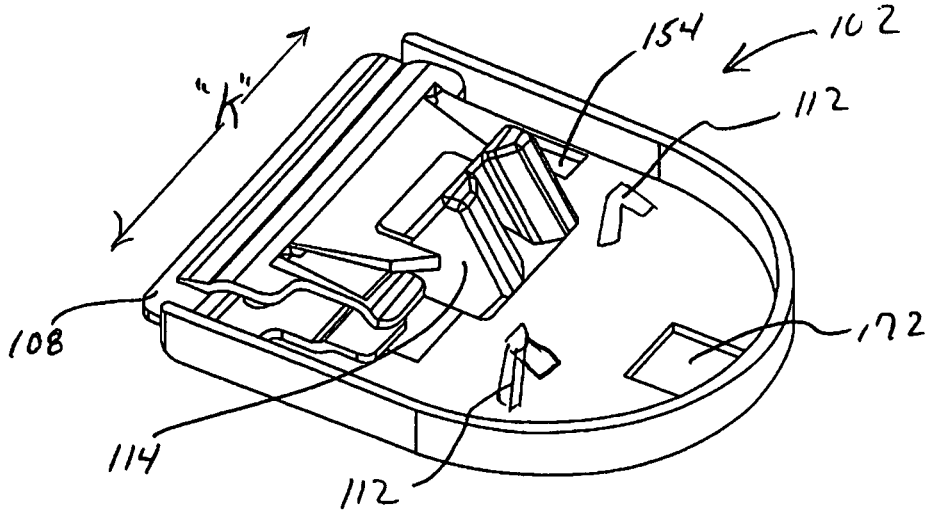
Figure 5:
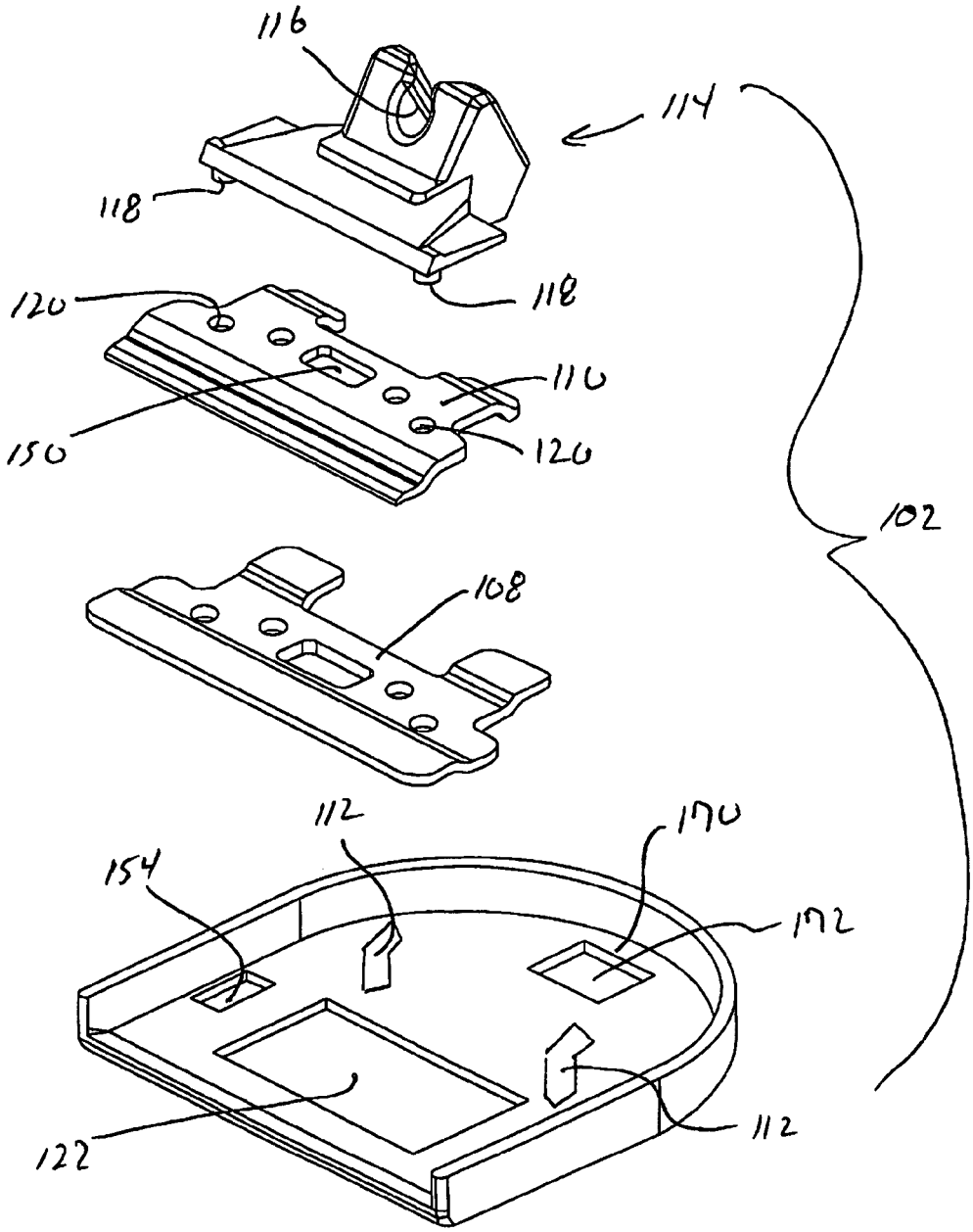
FIG. 5 is a perspective view with parts separated of the first blade set.

With reference now to FIGS. 4A, 4B and 5, in conjunction with FIGS. 3A and 3B, the first blade set 102 will be discussed. The first blade set 102 is directly mounted to the handle 12 and includes a first blade housing 106 having a first stationary blade 108 and a first movable blade 110. In the figures, the teeth of the first stationary and moveable blades 108, 110 are not illustrated. Any means for mounting the first blade set 102 to the handle are envisioned. In one embodiment, the mounting legs 22 of the handle 12 engage corresponding structure, e.g., mounting elements 112, of the first blade housing 102 in snap relation therewith to releasably secure the first blade set 102 to the handle 12.

The first blade set 102 further includes a reciprocating member 114 defining an opening or recess 116. The recess 116 receives the eccentric drive or cam post 20 connected to the drive shaft 18 which is coupled to the motor 16 and circuitry. Upon actuation of the motor 16, the eccentric cam post 20 rotates with the drive shaft 18 and within the recess 116 of the reciprocating member 114 to cause reciprocating movement of the reciprocating member 114 in the direction of directional arrows "k". (See FIG. 4B).

The reciprocating member 114 includes a pair of opposed mounting posts 118 at each end. The mounting posts 118 are received within corresponding openings 120 within the first movable blade 110 to connect the reciprocating member 114 to the first movable blade 110. Accordingly, reciprocating translating movement of the reciprocating member 114 is directly imparted to the first movable blade 110 during operation of the motor 16. The first stationary blade 108 is secured within the first blade housing 106 through conventional means. The first stationary blade 108 is also fixed relative to the first movable blade 110, thus cooperating with the first movable blade 110 to trim or cut hair. Any known means for securing the first stationary blade 108 are envisioned. The first blade housing 106 further includes a generally rectangular shaped opening 122 which is adjacent the second blade set 104 when the blade assembly 100 is in the assembled condition—the significance of which will be detailed hereinbelow.

Figure 6A:
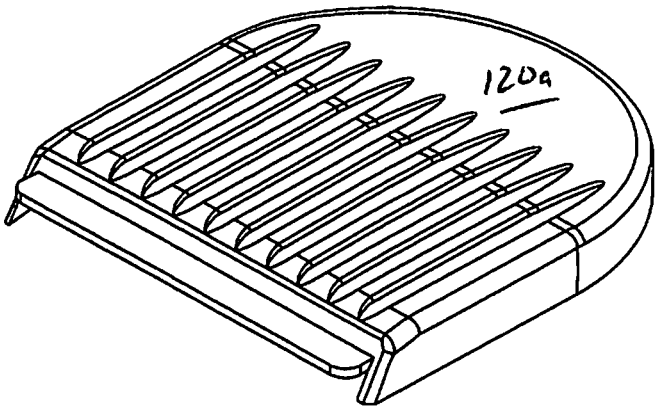
FIGS. 6A and 6B are perspective views of the second blade set of the blade assembly illustrating the treatment and trailing sides of the second blade set.
Figure 6B:
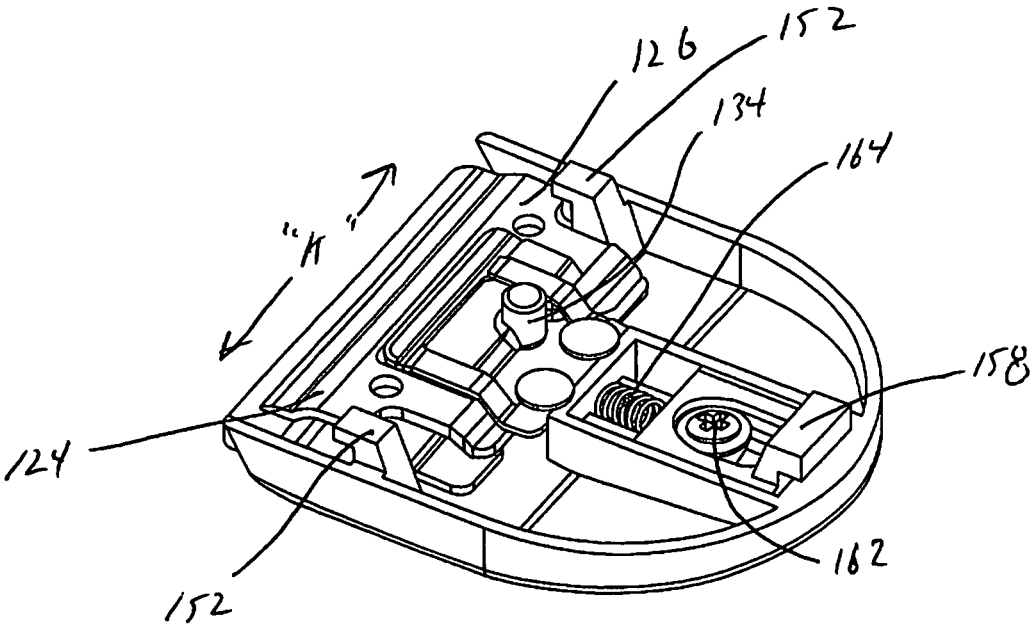
Figure 7:
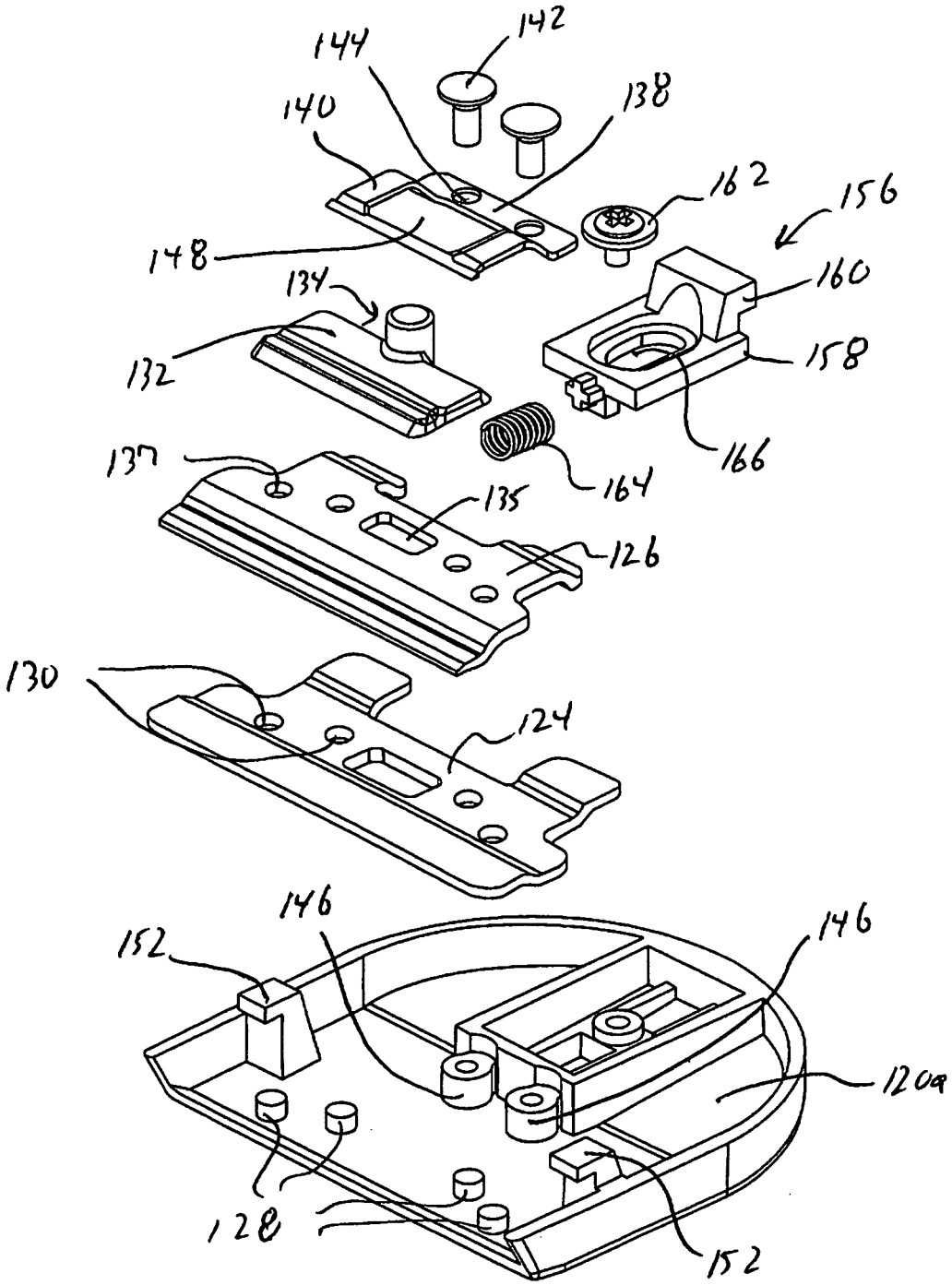
FIG. 7 is a perspective view with parts separated of the second blade set.

With reference now to FIGS. 6A, 6B and 7, in conjunction with FIGS. 3A and 3B, the second blade set 104 will be discussed. The second blade set 104 may be directly mounted to the first blade set 102 to provide an additional set of blades to enhance the versatility and/or cutting action of the grooming apparatus 10. The second blade set 104 includes a second blade housing 120*a* having a second stationary blade 124 and a second movable blade 126. The second stationary blade 124 may be secured to the second housing 120*a*. In one embodiment, spaced mounting posts 128 extending on the internal surface of the second housing 120*a* are received within correspondingly dimensioned and positioned openings 130 on the second stationary blade 124 to fix the second stationary blade 124 to the second housing 120*a*.

The second blade housing 120*a* further includes a second reciprocating or drive member 132 having a generally cylindrically shaped second drive post 134 depending outwardly therefrom. The lower segment 134*a* of the drive post 134 may be received within post aperture 135 of the second movable blade 126 to fix the drive member 132 to the second movable blade 126. Other means for securing the drive member 132 to the second movable blade 126 are also envisioned including the use of adhesives or with the use of a plurality of mounting posts (not shown) depending from the drive member 132 which are received within apertures 137 of the second movable blade 126.

A securing element 136 is mountable to the second housing 122 to retain the second reciprocating or drive member 132 against the second housing 122 while permitting reciprocating movement of the drive member 132 and the second movable blade 126. In one embodiment, the securing member 136 includes a cross beam 138 and two opposed longitudinal beams 140 extending from the cross beam 130. The longitudinal beams 140 define an angled or offset region which is positioned over the second movable blade 126. A pair of fasteners or screws 142 extends through openings in the cross beam 138 to be received (e.g., threadably) within mounting posts 146 of the second blade housing 122. With this arrangement, the second reciprocating member 132 and the second movable blade 126 are each mounted relative to the second blade housing 120*a*. The second reciprocating member 132 and the second movable blade 126 are capable of reciprocal movement in the direction of directional arrow "k". Other means for securing the second reciprocating member 132 relative to the second housing 120 while permitting reciprocal movement are also envisioned including torsional spring arrangements or the like.

Figure 8:
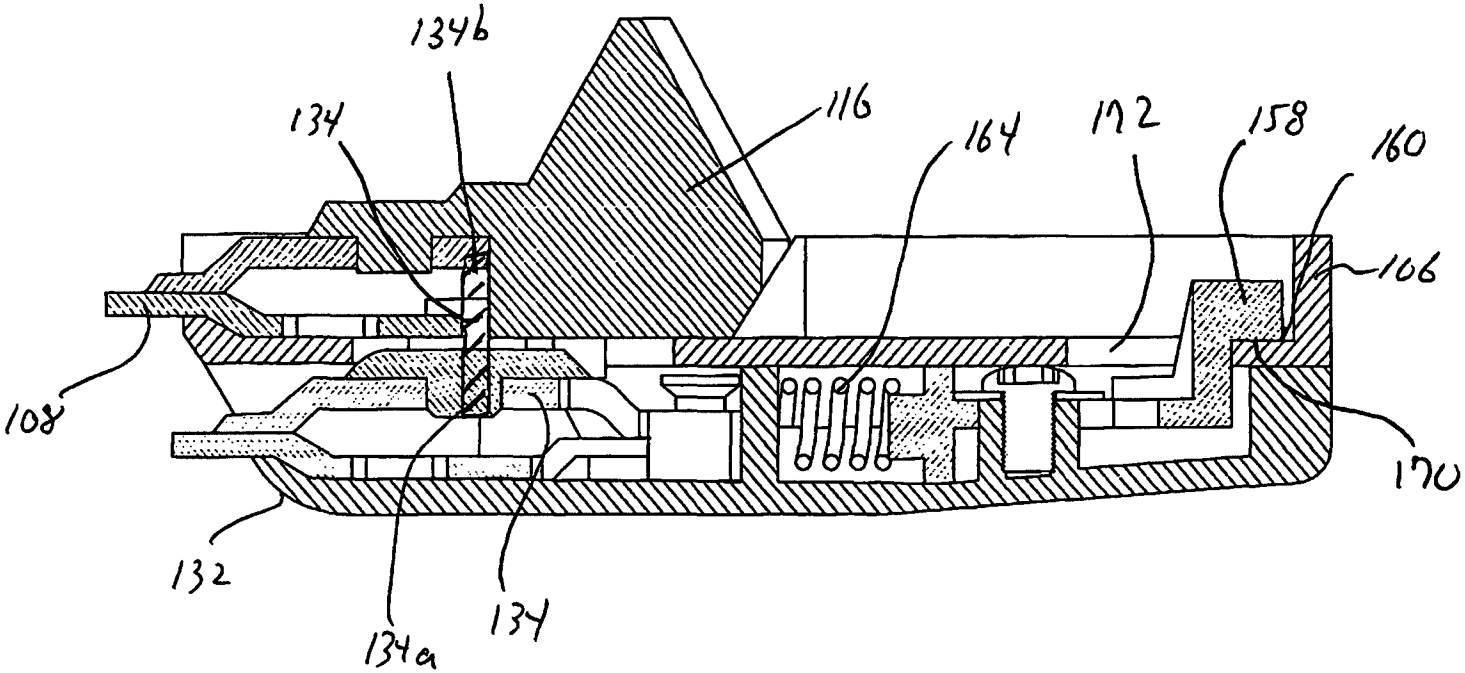
FIG. 8 is a side cross-sectional view illustrating the blade assembly in the assembled condition.

With reference to FIGS. 6B, 7 and 8 in conjunction with FIG. 5, the upper segment 134*b* of the second drive post 134 of the second reciprocating or drive member 132 extends upwardly through the opening 148 of the securing member 136 and through the generally rectangular shaped opening 122 of the first housing 106 (FIG. 5) to be received at least within the central opening 150 in the first movable blade 110. It is also envisioned that the first reciprocating member 114 may include a correspondingly dimensioned opening or recess aligned with the central opening 150 to receive a segment of the second drive post 134. With this arrangement, as the first reciprocating member 114 and the first movable member 110 move in reciprocating manner, the second reciprocating or drive member 132 and the second movable member 126 will correspondingly (and e.g., concurrently) move in the same directions; thus providing movement to each of the first and second movable blade members 110, 126 during actuation of the motor 16, e.g., thereby providing a double cutting action. In one arrangement, the edges of the second stationary and movable blades 124, 126 of the second blade set 104 are located closer to the handle 12, or staggered relative of the first blade set 102. (See, e.g. FIG. 3A) It is also envisioned that the edges of the second blade set 104 may extend beyond the blades of the first blade set 102 to provide alternative cutting capabilities.

With continued reference to FIGS. 6A, 6B, 7 and 8, the second blade set 104 further includes opposed mounting legs 152 which are received within corresponding mounting openings 154 of the first blade housing 106 of the first blade set 102 (FIG. 3B) when in the assembled condition of the components. The second blade set 104 further includes a latch mechanism 156 for releasably securing, or removably mounting, the second blade set 104 to the first blade set 102. The latch mechanism 156 includes a latch 158 having a latch segment or shelf 160, a set screw 162 for retaining the latch 158 within the second blade housing 122, and a coil spring 164. The set screw 162 extends within an elongated opening 166 within the latch 158, which opening 166 is dimensioned to permit the set screw 162 to traverse the opening 166 during reciprocating movement of the latch 158. The coil spring 164 is dimensioned to normally bias the latch 158 away from the stationary and movable blades 124, 126 such that the latch shelf 160 engages the latch edge 170 defined adjacent the latch opening 172 of the first housing 106 (see also FIG. 5) when in a lock position of the locking latch 158. In addition, the coil spring 164 will normally bias the mounting legs 152 into position to releasably engage the surfaces surrounding the mounting openings 154 of the first blade housing 106 thereby securing the first and second blade sets 102, 104. Thus, the latch mechanism 156 is adapted to normally bias the first and second blade sets 102, 104 to the operative condition depicted in FIGS. 3A, 3B and 8.

Figure 9A:
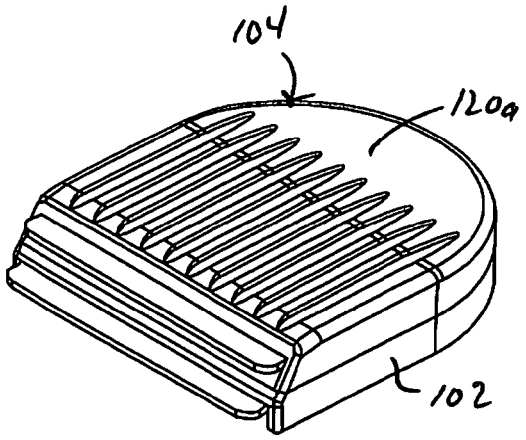
FIGS. 9A-9C, 10A-10C and 11A-11C are perspective, side and cross-sectional views illustrating a sequence of steps for causing relative movement of the first and second blade sets from an operative position to a release position to permit removal of the second blade set from the first blade set.
Figure 9B:
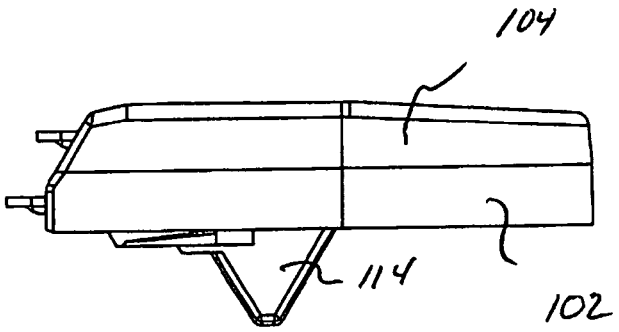
Figure 9C:
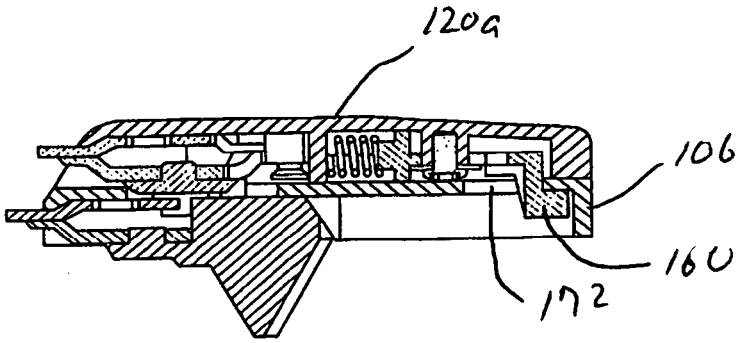
Figure 10A:
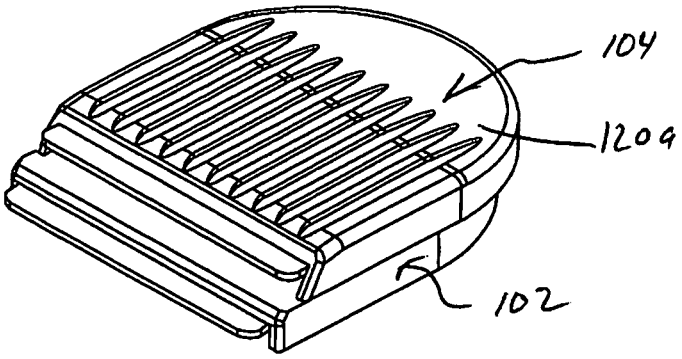
Figure 10B:
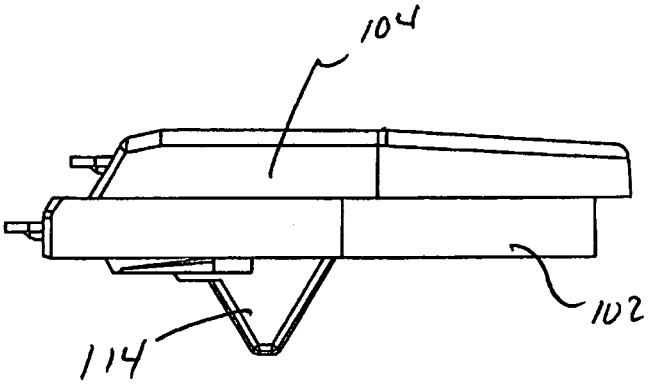
Figure 10C:
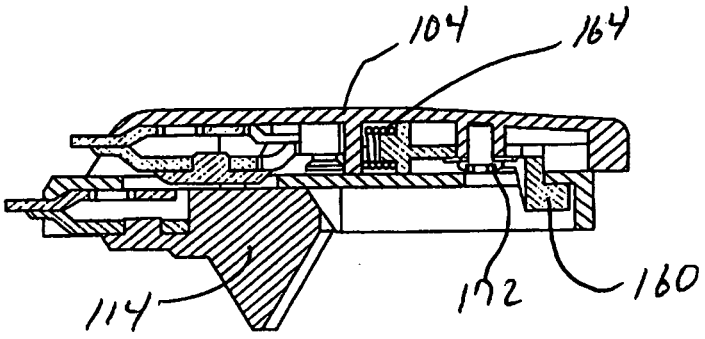
Figure 11A:
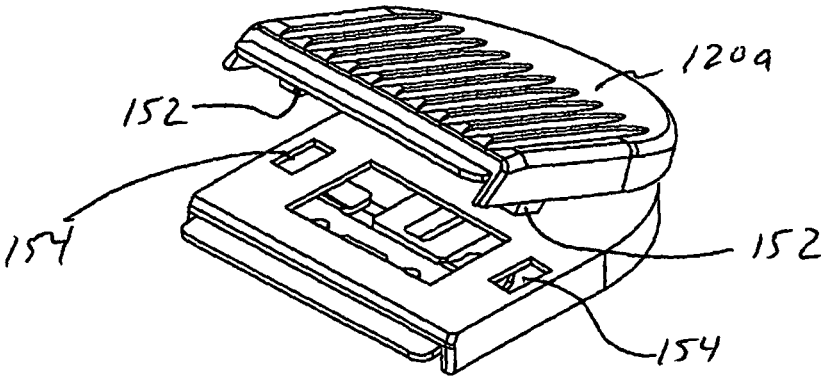
Figure 11B:
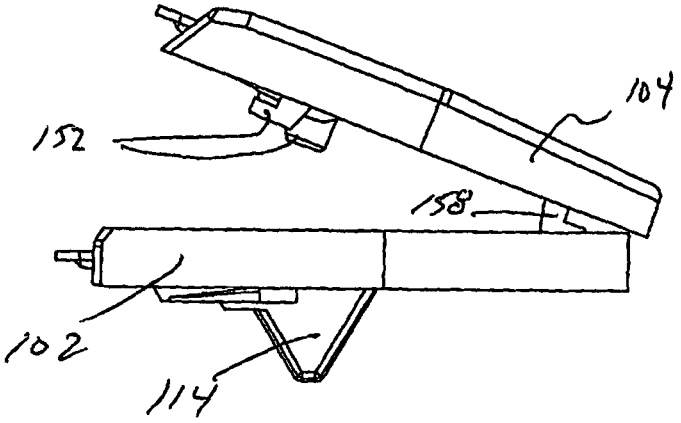
Figure 11C:
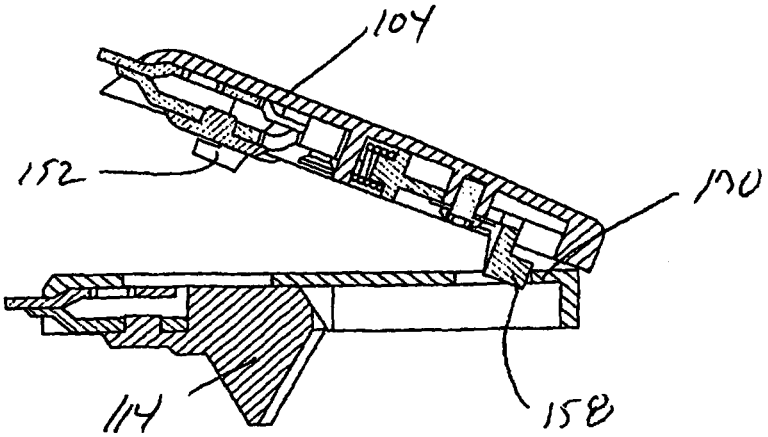

With reference now to FIG. 1, the grooming apparatus 10 may be used with the blade assembly 100 mounted thereto with the first and second blade sets 102, 104 operable to cut or trim hair. When it is desired to remove the second blade set 104, the apparatus may be deactivated. With reference to FIGS. 9A-9C, which depicts the blade assembly 100 detached from the handle 12, removal of the second blade set 104 is effected by advancing the second blade housing 122 in the direction of the directional arrows of FIGS. 9A-9C to the position of FIGS. 10A-10C. During this movement toward the release condition of the first and second blade sets 102, 104, the latch 158 of the latch mechanism 156 is driven against the bias of the coil spring 164 to contract the spring 164. This relative movement between the first and second blade housings 106, 120*a* positions the mounting legs 152 of the second blade set 104 in general alignment with the mounting openings 154 of the first blade set 102 to permit the mounting legs 152 to pass through the openings 154 thereby enabling removal of the second blade set 104 from the first blade set 102 as shown in FIGS. 11A-C. It is noted that the latch opening 172 of the second housing 120*a* is sufficient in dimension to permit removal of the latch 158 of the latch mechanism 156 through the opening 172 as well. Thereafter, the first blade set 102 may be mounted to the grooming apparatus 10 to trim or cut hair with the single first blade set 102.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A personal grooming apparatus, which comprises:

a handle defining a central longitudinal axis;

a blade housing;

first and second blade sets mountable relative to said handle and configured and positioned to depend outwardly from said blade housing to concurrently cut hair, said second blade set being releasably mountable to said first blade set, each blade set including a stationary blade member and a movable blade member;

a drive mechanism disposed within said handle and operatively coupled to said movable blade members of said first and second blade sets, said drive mechanism operable to cause corresponding reciprocating movement of said movable blade members relative to said stationary blade member of each of said first and second blade sets; and wherein said first and second blade sets include respective first and second housings for at least partially accommodating respective stationary and movable blade members, said first and second housings forming said blade housing.

2. The personal grooming apparatus according to claim 1 wherein said drive mechanism includes a rotating eccentric cam shaft, said cam shaft being operatively coupled to said movable blade members of said first and second blade sets such that rotational movement of said eccentric cam shaft causes corresponding reciprocating movement of said movable blade members.

3. The personal grooming apparatus according to claim 2 wherein said movable blade member of said first blade set is coupled to said eccentric cam shaft and said movable blade member of said second blade set is coupled to said movable blade member of said first blade set.

4. The personal grooming apparatus according to claim 3 wherein said second blade set includes a drive element operatively coupled to said movable blade member thereof, said drive element couplable to said movable blade member of said first blade set whereby reciprocating movement of said movable blade member of said first blade set causes corresponding reciprocating movement of said drive element to effect reciprocating movement of said movable blade member of said second blade set.

5. The personal grooming apparatus according to claim 4 wherein said drive element includes a drive post depending outwardly relative to said movable blade member of said second drive set, said drive post extending within said first housing of said first blade set and operatively couplable to said movable blade member of said first blade set.

6. The personal grooming apparatus according to claim 5 wherein said first blade set includes a reciprocating member coupled to said movable blade member and to said cam shaft of said drive mechanism.

7. The personal grooming apparatus according to claim 1 wherein said first and second blade sets are movable relative to each other between an operative condition and a release position where said first and second blade sets may be released.

8. The personal grooming apparatus according to claim 7 wherein said first and second blade sets are normally biased toward said operative condition thereof.

9. The personal grooming apparatus according to claim 8 wherein one of said first and second blade sets includes a main locking latch, said main locking latch adapted for movement between a lock position corresponding to said operative condition of said first and second blades sets and an unlock position corresponding to said release position of said first and second blades sets.

10. The personal grooming apparatus according to claim 9 wherein said main locking latch is normally biased toward said lock position.

11. The personal grooming apparatus according to claim 9 wherein the other of said first and second blade sets defines a latch shelf, said locking latch being engagable with said latch shelf during movement between said lock and unlock positions thereof.

12. The personal grooming apparatus according to claim 11 including at least one supplemental latch depending outwardly from one of said first housing or said second housing, said at least one supplemental latch being received within a correspondingly dimensioned supplemental latch opening in the other of said first housing or said second housing whereby movement of said first and second blade sets to said unlock position permits removal of said at least one supplemental latch from said correspondingly dimensioned supplemental latch opening to permit removal of said second blade set from said first blade set.

13. The personal grooming apparatus according to claim 12 including at least two of said supplemental latches depending outwardly from said one of said first housing or said second housing, said at least two supplemental latches being received within correspondingly dimensioned supplemental latch openings in said other of said first housing or said second housing.

14. The personal grooming apparatus according to claim 10 wherein said first blade set is releasably mountable to said handle.

15. A blade apparatus for use with a hair clipper, which comprises:

a first blade set for mounting to the hair clipper, said first blade set including a first housing, a first movable blade member and a first stationary blade member, said first moveable member being adapted for reciprocal movement relative to aaid stationary blade member; and a second blade set including a second housing, a second movable blade member and a second stationary blade member, said second housing being movable between an operative condition mounted to said first housing of said first blade set with said second movable blade member operatively coupled to said first movable blade member, and a release condition released from said first housing, said first and second blades set configured and dimensioned to depend outwardly relative to each said first and second housings to concurrently cut hair when in said operative condition.

16. The blade apparatus according to claim 15 wherein said second blade set includes a drive post operatively coupled to said second movable blade member, said drive post operatively coupled to said first movable member when in said operative condition thereof whereby movement of said first movable blade member causes corresponding reciprocating movement of said second movable blade member.

17. The blade apparatus according to claim 16 wherein said second housing of said second blade set includes a main locking latch, said main locking latch adapted for movement between a lock position corresponding to said operative condition of said first and second blades sets and an unlock position corresponding to said release position of said first and second blades sets, said main locking latch is normally biased toward said lock position.

18. The blade apparatus according to claim 17 including at least one supplemental latch depending outwardly from said second housing of said second blade set, said at least one supplemental latch being received within a correspondingly dimensioned supplemental latch opening in said first housing of said first blade set whereby movement of said first and second blade sets to said release position permits removal of said at least one supplemental latch from said correspondingly dimensioned supplemental latch opening to permit removal of said second blade set from said first blade set.

* * * * *